US007898368B2

(12) United States Patent
Shen

(10) Patent No.: US 7,898,368 B2
(45) Date of Patent: Mar. 1, 2011

(54) FILTER UNIT

(75) Inventor: Wen-Chao Shen, Taoyuan County (TW)

(73) Assignee: Azure Shine International Inc., Bade (TW)

( * ) Notice: Subject to any disclaimer, the term of this patent is extended or adjusted under 35 U.S.C. 154(b) by 158 days.

(21) Appl. No.: 12/369,373

(22) Filed: Feb. 11, 2009

(65) Prior Publication Data

US 2010/0052823 A1 Mar. 4, 2010

(30) Foreign Application Priority Data

Aug. 29, 2008 (TW) ..... 97133224 A

(51) Int. Cl.
*H01P 1/211* (2006.01)

(52) U.S. Cl. ..... 333/208; 333/211

(58) Field of Classification Search ..... 333/208, 333/209, 210, 211, 212, 202, 219
See application file for complete search history.

(56) References Cited

U.S. PATENT DOCUMENTS

| | | | | |
|---|---|---|---|---|
| 3,777,286 | A * | 12/1973 | Cramm et al. | 333/185 |
| 5,739,734 | A * | 4/1998 | Chen et al. | 333/210 |
| 6,809,696 | B1 * | 10/2004 | Bergmark et al. | 343/786 |
| 2004/0017272 | A1 * | 1/2004 | Smith et al. | 333/209 |

* cited by examiner

*Primary Examiner*—Stephen E Jones
(74) *Attorney, Agent, or Firm*—Alston & Bird LLP

(57) ABSTRACT

A filter unit comprises a cover and a base. The cover includes a number of first grooves, and the base includes a number of second grooves aligned with the first grooves. At least one of the cover or the base includes an alloy of zinc and aluminum, wherein the weight percentage of zinc is greater than that of aluminum.

18 Claims, 5 Drawing Sheets

FILTER UNIT

BACKGROUND OF THE INVENTION

The present invention relates generally to satellite communications and, more particularly, to a filter unit for satellite communications.

In satellite communications, signal quality may be susceptible to communication environments such as terrestrial topology and weather conditions. A filter may usually be used to suppress interference or noise in received signals.

FIG. 1A is a schematic cross-sectional view of a conventional filter unit 1. Referring to FIG. 1A, the filter unit 1 may include a base 11 and a number of tuning pins 12 each corresponding to one of a number of grooves 112 of the base 11. The depth of each groove 112 may be adjusted by a corresponding one of the tuning pins 12 so as to filter signals at frequencies of interest. However, the conventional filter unit 1 may generally include an alloy of aluminum and zinc, in which the weight percentage of aluminum is greater than that of zinc. Such weight percentage may result in undesirable surface roughness of the grooves 112, which may adversely affect the function of a filtering space 111 defined by the grooves 112 and in turn the performance of the filter unit 1.

BRIEF SUMMARY OF THE INVENTION

Examples of the present invention may provide a filter unit that comprises a cover including a number of first grooves, and a base including a number of second grooves aligned with the first grooves.

Some examples of the present invention may also provide a filter unit that comprises a cover including a number of first grooves, and a base including a number of second grooves aligned with the first grooves, wherein the cover includes an alloy of zinc and aluminum, and the weight percentage of zinc is greater than that of aluminum.

Examples of the present invention may further provide a filter unit that comprises a cover including a number of first grooves, and a base including a number of second grooves aligned with the first grooves, wherein the base includes an alloy of zinc and aluminum, and the weight percentage of zinc is greater than that of aluminum.

Other objects, advantages and novel features of the present invention will be drawn from the following detailed embodiments of the present invention with attached drawings, in which:

BRIEF DESCRIPTION OF THE SEVERAL VIEWS OF THE DRAWINGS

The foregoing summary as well as the following detailed description of the preferred embodiments of the present invention will be better understood when read in conjunction with the appended drawings. For the purposes of illustrating the invention, there are shown in the drawings examples which are presently preferred. It is understood, however, that the invention is not limited to the precise arrangements and instrumentalities shown. In the drawings.

DETAILED DESCRIPTION OF THE INVENTION

Reference will now be made in detail to the present examples of the invention illustrated in the accompanying drawings. Wherever possible, the same reference numbers will be used throughout the drawings to refer to the same or like portions.

Figure 1:
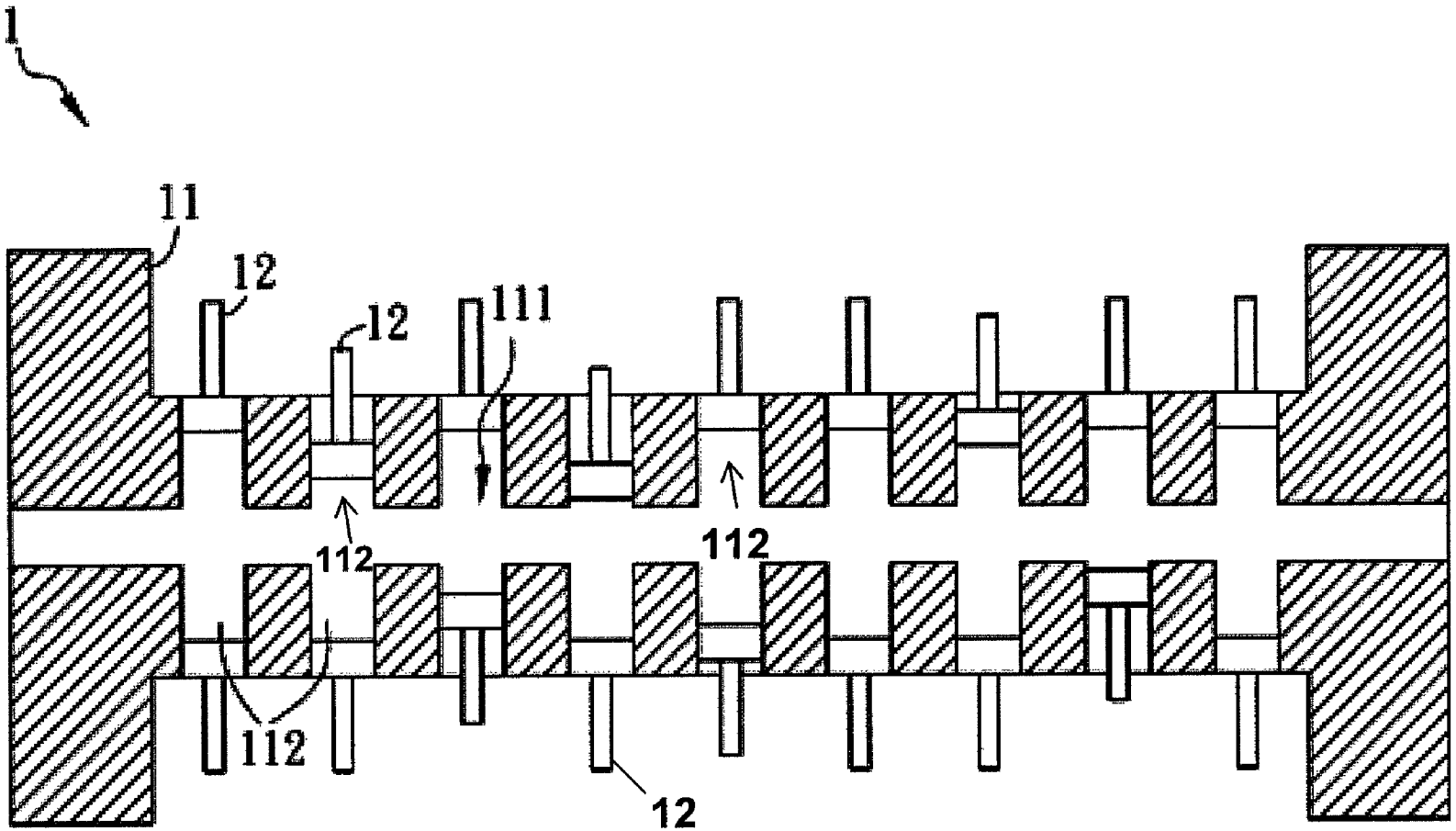
FIG. 1 (PRIOR ART)
FIG. 1A is a schematic cross-sectional view of a conventional filter unit.
Figure 2A:
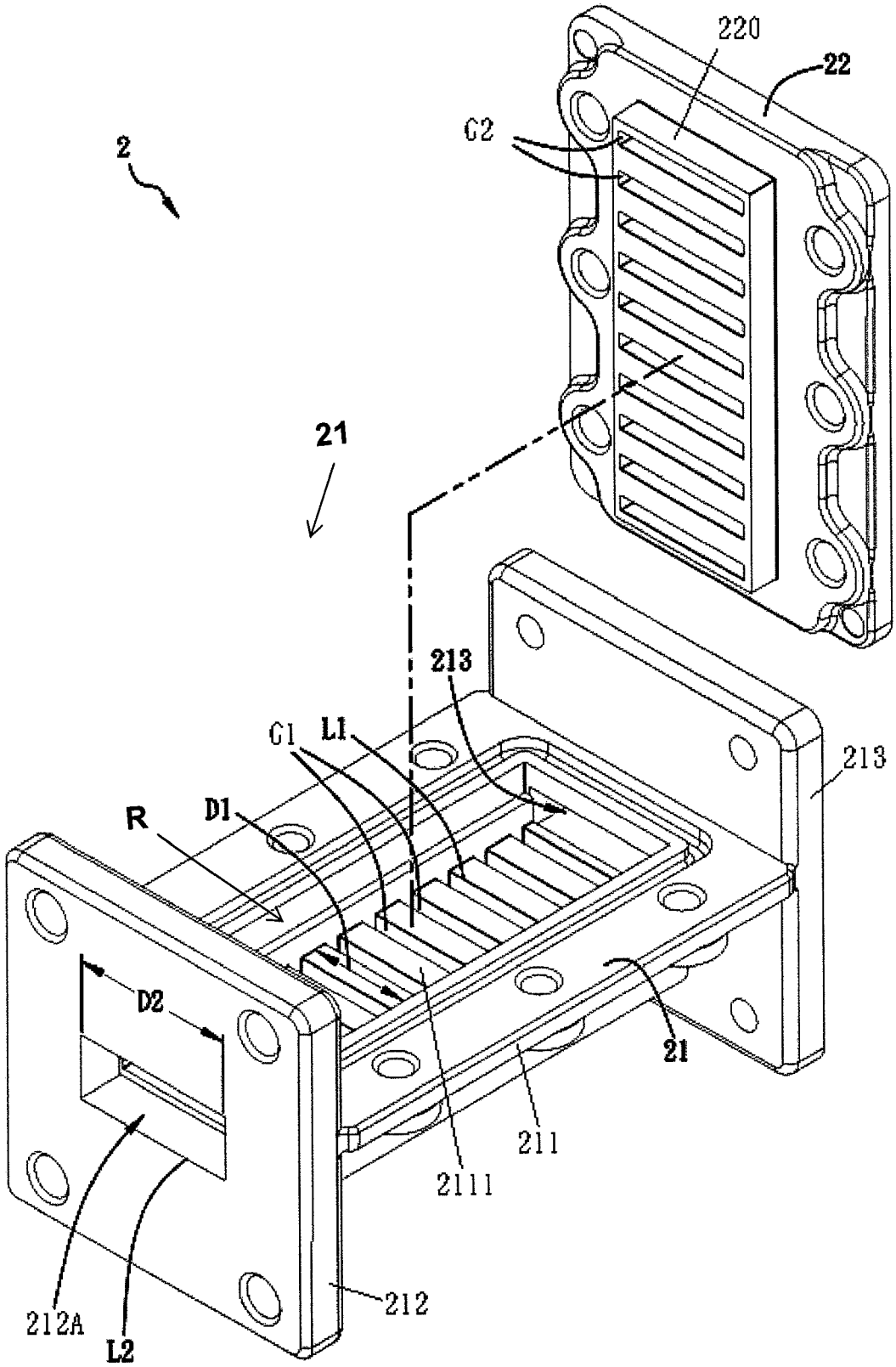
FIG. 2A is an unfolded, perspective view of a filter unit in accordance with an example of the present invention.

FIG. 2A is an unfolded, perspective view of a filter unit 2 in accordance with an example of the present invention. Referring to FIG. 2A, a filter unit 2 may include a base 21 and a cover 22. At least one of the base 21 or the cover 22 may include an alloy of aluminum (Al) and zinc (Zn), wherein the weight percentage of zinc may be greater than that of aluminum. Experiments reveal that surface roughness or surface texture of a filter unit comprising an Al—Zn alloy may be improved when zinc is greater than aluminum in weight percentage. The surface roughness or surface texture may be measured by several methods such as roughness average ($R_a$), root-mean-square (rms) and maximum height of profile ($R_{max}$).

In one example, the weight percentage of zinc is equal to or greater than approximately 90%. In another example, the weight percentage of zinc is equal to or smaller than approximately 99%. In still another example, the weight percentage of aluminum is equal to or greater than approximately 1%. In yet another example, the weight percentage of aluminum is equal to or smaller than approximately 10%. In yet still another example, the alloy may include approximately 90% to 99% of zinc and approximately 1% to 10% of aluminum by weight.

Furthermore, in one example, the weight percentage of zinc is equal to or greater than approximately 95%. In another example, the weight percentage of zinc is equal to or smaller than approximately 96%. In still another example, the weight percentage of aluminum is equal to or greater than approximately 3.9%. In yet another example, the weight percentage of aluminum is equal to smaller than approximately 4.3%. In yet still another example, the alloy may include approximately 95% to 96% of zinc and approximately 3.9% to 4.3% of aluminum by weight.

The base 21 may include a first support 212, a second support 213, and a body 211 between the first and second supports 212 and 213. The body 211 may include a recessed portion "R" with a bottom surface (not numbered). A number of protrusions 2111 may protrude from the bottom surface and may be separated from one another by a groove "G1". The first support 212 may include a first opening 212A for signal input and the second support 213 may include a second opening 213A for signal output.

The cover 22 may include a raised portion 220 with a number of grooves "G2". In the present example, each of the raised portion 220 and the recessed portion R may have a rectangular shape. When the recessed portion R and the raised portion 220 engage with one another, the grooves G1 and G2 may be aligned with one another. Each of the grooves G1 and G2 may extend in a first direction, which may be orthogonal to a second direction in which a signal to be filtered transmits from the first opening 212A to the second opening 213A.

Figure 2B:
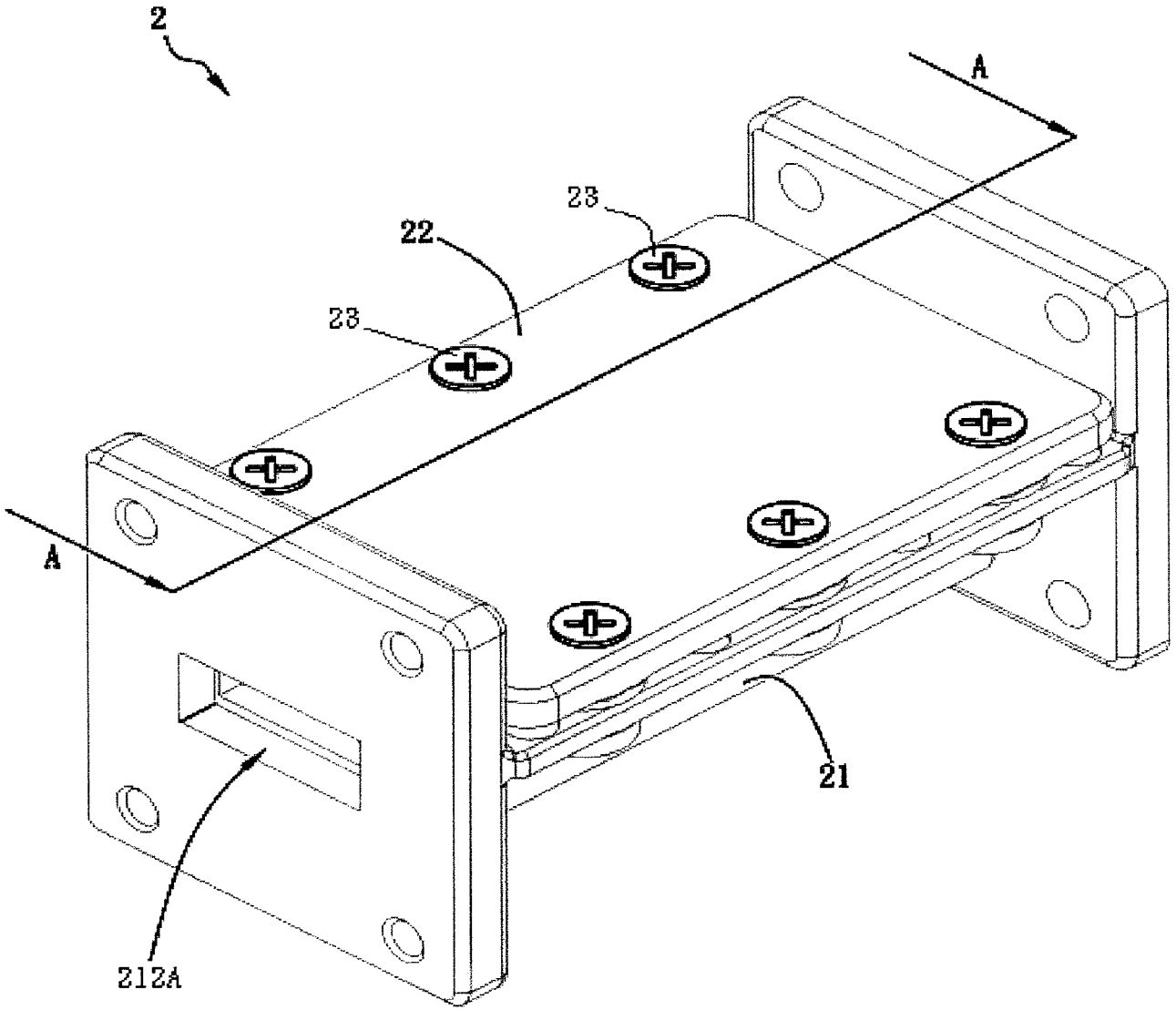
FIG. 2B is a folded, perspective view of the filter unit illustrated in FIG. 2A.

FIG. 2B is a folded, perspective view of the filter unit 2 illustrated in FIG. 2A. Referring to FIG. 2B, a number of fastening means 23 such as screws, bolts and rivets may be used to engage the cover 22 with the base 21.

Figure 2C:
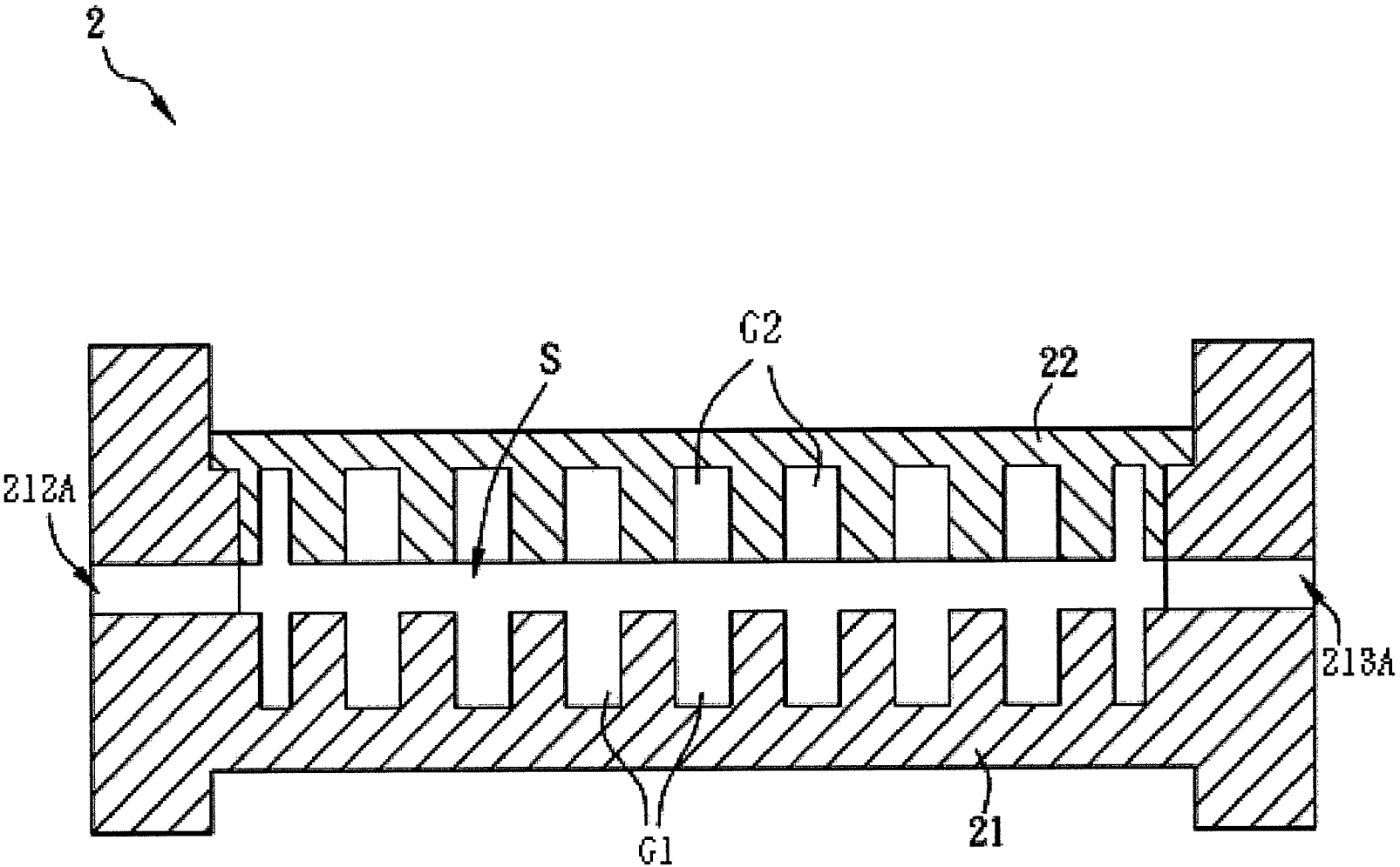
FIG. 2C is a cross-sectional view of the filter unit illustrated in FIG. 2B.

FIG. 2C is a cross-sectional view of the filter unit 2 illustrated in FIG. 2B taken along a line AA'. Referring to FIG. 2C, the grooves G1 and G2 and a space "S" defined by the engaged base 21 and the cover 22 may function as a filter that allows a signal at a frequency within a predetermined range to pass the outlet 213A.

Figure 3:
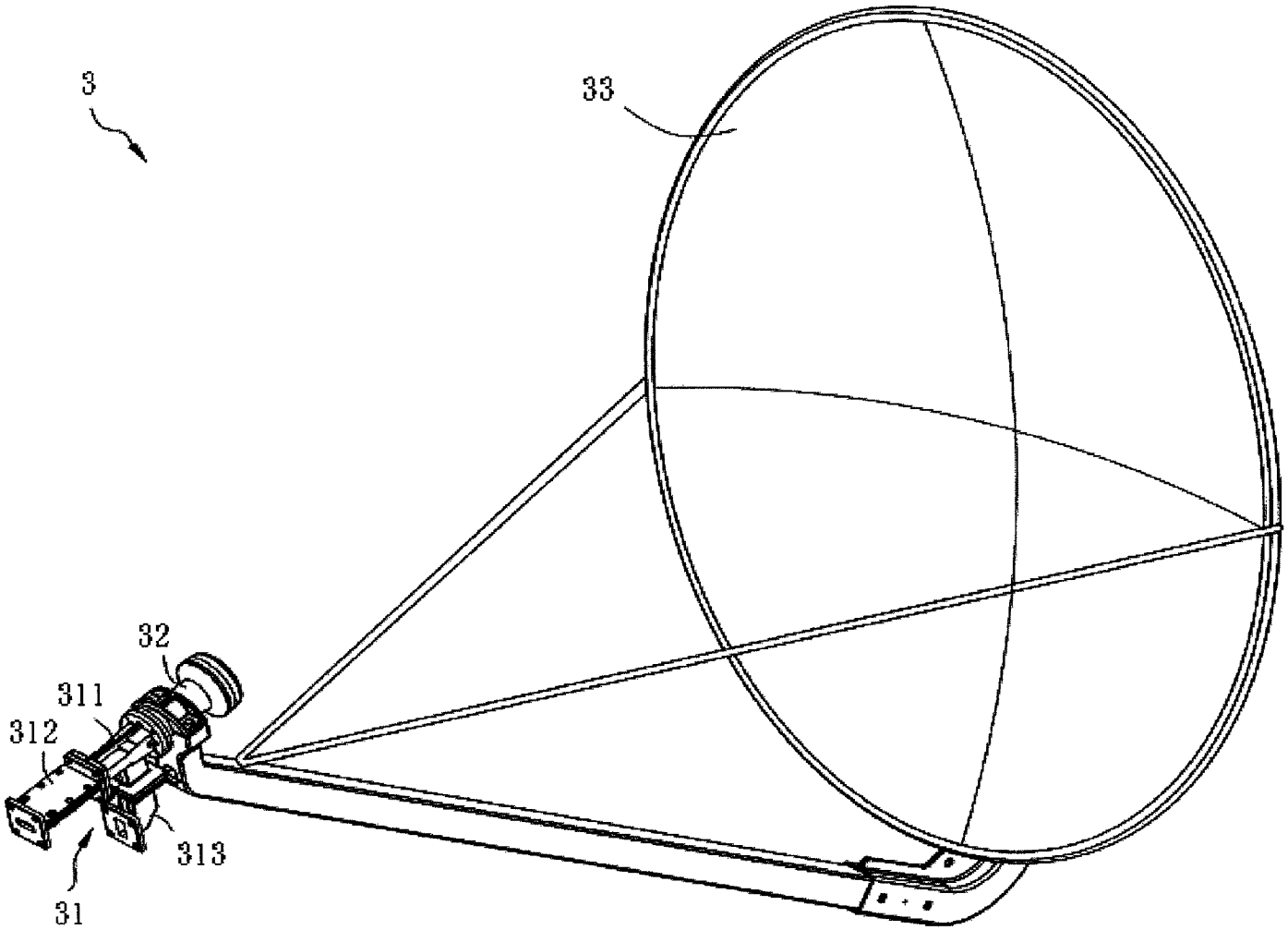
FIG. 3 is a perspective view of a communication device in accordance with an example of the present invention.

FIG. 3 is a perspective view of a communication device 3 in accordance with an example of the present invention. Referring to FIG. 3, the communication device 3 may include a transceiver module 31, a feeding module 32 coupled to the transceiver module 31 and a reflection module 33. The transceiver module 31 may include a transducer 311, a filter unit 322 which may be similar to the filter unit 2 described and illustrated with reference to FIGS. 2A to 2C, and a waveguide 323. The transducer 311 may include an orthogonal mode transducer (OMT) coupled between the filter unit 322 and the waveguide 323.

In describing representative examples of the present invention, the specification may have presented the method and/or process of operating the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

It will be appreciated by those skilled in the art that changes could be made to the examples described above without departing from the broad inventive concept thereof. It is understood, therefore, that this invention is not limited to the particular examples disclosed, but it is intended to cover modifications within the spirit and scope of the present invention as defined by the appended claims.

That which is claimed is:

1. A filter unit comprising:

a cover including a raised portion in which a number of first grooves are disposed, wherein the raised portion has a rectangular shape; and a base including a recessed portion in which a number of second grooves are disposed, wherein the recessed portion has the rectangular shape and the second grooves are aligned parallel and opposite to the first grooves.

2. The filter unit of claim 1, wherein the base includes a first support, a second support and a body between the first support and the second support, wherein the body comprises the recessed portion.

3. The filter unit of claim 2, wherein the first support includes a first opening and the second support includes a second opening.

4. The filter unit of claim 3, wherein each of the first and second grooves extends in a first direction orthogonal to a second direction from the first opening to the second opening.

5. The filter unit of claim 1, wherein at least one of the cover or the base includes an alloy of zinc and aluminum, and the weight percentage of zinc is greater than that of aluminum.

6. The filter unit of claim 5, wherein the alloy comprises 90% to 99% of zinc and 1% to 10% of aluminum.

7. The filter unit of claim 5, wherein the alloy comprises 95% to 96% of zinc.

8. The filter unit of claim 5, wherein the alloy comprises 3.9% to 4.3% of aluminum.

9. The filter unit of claim 5, wherein the weight percentage of zinc is equal to or greater than 90%.

10. The filter of claim 9, wherein the weight percentage of zinc is equal to or smaller than 99%.

11. The filter unit of claim 5, wherein the weight percentage of aluminum is equal to or greater than 1%.

12. The filter unit of claim 11, wherein the weight percentage of aluminum is equal to or smaller than 10%.

13. A filter unit comprising:

a cover including a raised portion in which a number of first grooves are disposed, wherein the raised portion has a rectangular shape; and a base including a recessed portion in which a number of second grooves are disposed, wherein the recessed portion has the rectangular shape and the second grooves are aligned parallel and opposite to the first grooves, wherein the cover includes an alloy of zinc and aluminum, and the weight percentage of zinc is greater than that of aluminum.

14. The filter unit of claim 13, wherein the alloy comprises 90% to 99% of zinc and 1% to 10% of aluminum.

15. The filter unit of claim 13, wherein the alloy comprises 95% to 96% of zinc and 3.9% to 4.3% of aluminum.

16. A filter unit comprising:

a cover including a raised portion in which a number of first grooves are disposed, wherein raised portion has a rectangular shape; and a base including a recessed portion in which a number of second grooves are disposed, wherein the recessed portion has the rectangular shape and the second grooves are aligned parallel and opposite to the first grooves, wherein the base includes an alloy of zinc and aluminum, and the weight percentage of zinc is greater than that of aluminum.

17. The filter unit of claim 16, wherein the alloy comprises 90% to 99% of zinc and 1% to 10% of aluminum.

18. The filter unit of claim 16, wherein the alloy comprises 95% to 96% of zinc and 3.9% to 4.3% of aluminum.

* * * * *